US005927062A

United States Patent [19]

Deno et al.

[11] Patent Number: 5,927,062

[45] Date of Patent: Jul. 27, 1999

[54] FIBER SPINNING APPARATUS HAVING FIBER TWISTING GUIDE

[75] Inventors: Koji Deno, Omihachiman; Tomoaki Takahashi, Kyoto, both of Japan

[73] Assignee: Murata Kikai Kabushiki Kaisha, Kyoto, Japan

[21] Appl. No.: 08/987,770

[22] Filed: Dec. 9, 1997

[30] Foreign Application Priority Data

Jan. 16, 1997 [JP] Japan ..... 9-017925

[51] Int. Cl.[6] ..... D01H 5/00

[52] U.S. Cl. ..... 57/333; 57/328; 57/350; 57/352

[58] Field of Search ..... 57/315, 328, 333, 57/350, 352

[56] References Cited

U.S. PATENT DOCUMENTS

| | | | |
|---|---|---|---|
| 5,088,265 | 2/1992 | Suganuma et al. | 57/328 |
| 5,211,001 | 5/1993 | Mori | 57/333 |
| 5,263,310 | 11/1993 | Mori | 57/333 |
| 5,295,349 | 3/1994 | Okamoto | 57/333 |
| 5,528,895 | 6/1996 | Deno | 57/350 |
| 5,647,197 | 7/1997 | Imamura | 57/352 |

FOREIGN PATENT DOCUMENTS

| | | | |
|---|---|---|---|
| 6-287823 | 10/1994 | Japan | 57/328 |

*Primary Examiner*—William Stryjewski
*Attorney, Agent, or Firm*—Armstrong, Westerman, Hattori, McLeland & Naughton

[57] ABSTRACT

A spinning apparatus having a nozzle n1 that applies a rotating air current to fibers f and a hollow spindle s1, wherein a fiber introduction member E with a fiber guide surface e8 having a torsion angle of 100° or more is disposed, without a needle shaped guide member e2, near the tip s1" of the fiber introduction side of the hollow spindle. Since the torsion angle of a fiber guide surface of the fiber introduction member is 100° or more, fibers can be bundled easily without the needle shaped guide member and leaves and other foreign matter contained in a sliver are prevented from accumulating between the fiber introduction member and the hollow spindle, thereby reducing the frequency of yarn breakage and improving the spinning capability.

5 Claims, 5 Drawing Sheets

FIBER SPINNING APPARATUS HAVING FIBER TWISTING GUIDE

FIELD OF THE INVENTION

The present invention relates to a spinning apparatus for producing spun yarn using a rotating air current.

BACKGROUND OF THE INVENTION

There are known spinning apparatuses for producing spun yarn by twisting fibers using a rotating air current, having a nozzle that applies a rotating air current to a sliver fed from a draft device, a hollow spindle and a needle shaped guide member having a tip opposed to the tip of the fiber introduction side of the hollow spindle.

In the conventional spinning apparatus, as shown in FIG. 3, a sliver L supplied via a sliver guide G is drafted by a draft device D composed of a back roller d1, a third roller d2, a second roller d3 with an apron and a front roller d4, and is then fed to a twist device T consisting of a nozzle member and a spindle member that can be contacted with and separated from each other, in which the sliver is formed into spun yarn Y, which is then passed through a spun yarn feed device H consisting of a nip roller h1 and a delivery roller h2 and a slab catcher Z. The yarn Y is then wound around a package w3 driven by a friction roller w1 and supported by a cradle am w2 in a winding section W.

The twist device T consisting of the nozzle member N and the spindle member S is described below with reference to FIG. 4.

n1 is a nozzle gripped by a nozzle housing n2 and a flange portion n3' of a nozzle outer frame n3, and mounted by the nozzle housing n2 and the nozzle outer frame n3 by coupling the nozzle housing n2 and the nozzle outer frame n3 using a bolt n4. n5 is an air chamber formed by the nozzle n1 and the nozzle housing n2, and air injection holes n7 are formed in the tangential direction of the inner circumferential surface of the nozzle n1 in such a way as to allow the air chamber n5 to communicate with a generally cylindrical hollow chamber n6 in the nozzle n1. A plurality of, for example, four air injection holes n7 are formed along the circumference direction of the nozzle n1. The nozzle member N is mainly composed of the nozzle n1, the nozzle housing n2 and the nozzle outer frame n3.

s1 is a non-rotatable hollow spindle mounted on a spindle supporting frame s2 and having a hollow passage s1', and s3 is a sliding frame mounted on the nozzle outer frame n3 and having a guide hole s4 in which a guide rod G is loosely fitted. The sliding frame s3 has at its approximate center a hole s3' into which part of the spindle supporting frame s2 and the end part of the spun yarn exit side of the hollow spindle s1 mounted on the spindle supporting frame s2 is inserted.

Furthermore, the sliding frame s3 has a plurality of, for example, three holes s5 formed horizontally at appropriate intervals, and a flange portion s6 having a bolt insertion hole s6' with a smaller diameter than the inner diameter of the hole s5 is swollen in the middle of the circumference of the hole s5. s7 is a protruding portion provided on the spindle supporting frame s2, the tip of which is inserted into the hole s5.

s8 is a bolt with a head s8' abutting the flange portion s6 swollen in extending across the hole s5 or located in proximity to the flange portion s6, a barrel s8" inserted into the bolt insertion hole s6' and a threaded tip screwed into the protruding portion s7 provided on the spindle supporting frame s2. s9 is a compression coil spring disposed between the flange portion s6 and the end surface of the protruding portion s7 provided on the spindle supporting frame s2. The spindle supporting frame s2 is coupled to the sliding frame s3 via the bolt s8, and the spindle supporting frame s2 and the sliding frame s3 are forced by the compression coil spring s9 to move apart.

s2' is an approximately disc-shaped fitting portion provided on the nozzle s1 side of the spindle supporting frame s2. The end of the spun yarn exit side of the hollow spindle s1 is shaped like a trumpet so as to guide the leading yarn that is passed through the hollow passage s1' of the hollow spindle s1 during a piecing operation.

s10 is a pin protruding from the side wall of the sliding frame s3 and fitted in a recessed portion v1 provided at the tip of an oscillating lever V that can be oscillated around a predetermined supporting point in the lateral direction in FIG. 4 by a piston rod (not shown in the drawing). Thus, the oscillating lever V can be moved leftward in FIG. 4 to move the spindle member S leftward along the guide rod G via the pin s10 fitted in the recessed portion v1 in the oscillating lever V, thereby separating the spindle member S from the nozzle member N. Conversely, the spindle member S can be moved rightward to fit the fitting portion s2' of the spindle member S in an opening n3" of the nozzle outer frame n3 of the nozzle member N, thereby allowing the spindle member S to be coupled to the nozzle member N, as shown in FIG. 4. d4' is a front bottom roller.

As shown in FIGS. 4 and 5, a fiber introduction member having a fiber introduction hole e1 with an approximately flat fiber guide surface e1' and inserted into a recessed portion n8 formed on the front roller d4 side of the nozzle n1 so as to be opposite to the tip s1" of the hollow spindle s1 having the hollow passage s1'. e2 is a needle shaped guide member mounted in the fiber introduction hole e1 and close to the tip s1" of the hollow spindle s1.

n9 is an air chamber provided in the nozzle member N and in communication with a suction duct via a hole (not shown in the drawing), and the suction duct is connected to an air suction device (not shown in the drawing) in order to maintain the air chamber n9 at a low negative pressure. Therefore, fly fibers generated in the hollow chamber n6 during producing the spun yarn Y are removed through the gap between the inner circumferential surface of the nozzle n1 and the outer circumferential surface of the hollow spindle s1.

A process for producing the spun yarn Y using the twist device T consisting of the nozzle member N and the spindle member S is described below.

The drafted sliver L fed from the front roller d4 of the draft device D is sucked into the fiber introduction hole e1 of the fiber introduction member E by a suction air current generated near the fiber introduction hole e1 by air jetted from the air injection holes n7 formed in the nozzle n1. Fibers f constituting the sliver L sucked into the fiber introduction hole e1 are fed along the approximately flat fiber guide surface e1' and guided around the needle shaped guide member e2 mounted on the spindle member S side of the fiber guide surface e1' while entering the approximately cylindrical hollow chamber n6. The fibers f constituting the sliver L sucked into the hollow chamber n6 are subjected to a rotating air current that is jetted from the air injection holes n7 and swirled over the outer circumference of the hollow spindle s1 at a high speed, and are separated from the sliver L while being twisted in the direction of the rotating air current. Part of the twisting applied by the rotating air current attempts to propagate toward the front roller d4, but the propagation is hindered by the needle shaped guide member e2 to prevent the sliver L fed from the front roller d4 from being twisted with the fibers. The twisted fibers f are formed sequentially into spun yarn Y, which is then passed through the hollow passage s1' of the hollow spindle s1 and fed toward the winding section W.

In the conventional spinning apparatus, since the needle shaped member e2 is disposed opposite to the tip s1" of the fiber introduction side of the hollow spindle s1 as shown in FIGS. 4 and 5, the transfer passage for the fibers f passing from the needle shaped guide member e2 to the hollow passage s1' of the hollow spindle s1 is narrow and may be blocked by leaves and other foreign matter contained in the sliver L, resulting in yarn breakage.

In addition, since the needle shaped member e2 is disposed opposite to the tip s1" of the fiber introduction side of the hollow spindle s1, the ballooning of the fibers f around the tip s1" of the hollow spindle s1 is significant, disturbing the fibers f and preventing uniform spun yarn Y from being produced.

Furthermore, since the needle shaped member e2 is disposed opposite to the tip s1" of the fiber introduction side of the hollow spindle s1, this prevents the leading yarn from being passed through the hollow passage s1' of the hollow spindle s1 and the fiber introduction hole e1 of the fiber introduction member E during a piecing operation.

Furthermore, since the needle shaped member e2 is disposed opposite to the tip s1" of the fiber introduction side of the hollow spindle s1, the gap between the needle shaped guide member e2 and the hollow passage s1' of the hollow spindle s1 is small, increasing the tension of the fibers f passing though this gap and resulting in hard spun yarn Y being produced. If the diameter of the hollow passage s1' of the hollow spindle s1 is increased to expand the gap between the needle shaped guide member e2 and the hollow passage s1' of the hollow spindle s1 in order to solve the above problem, then the fibers f become difficult to bundle, resulting in degraded spinning capability.

It is an object of the present invention to solve the above problems with the conventional spinning apparatus for spinning yarn using a rotating air current and to provide a spinning apparatus with an improved spinning capability.

SUMMARY OF THE INVENTION

To achieve this object, the present invention provides a spinning apparatus with a nozzle applying a rotating air current to fibers and a hollow spindle, wherein a fiber introduction member with a fiber guide surface having a torsion angle of 90° or more is disposed to supply fibers fed from the fiber introduction member directly to an input port in the hollow spindle. In addition, the torsion angle of said fiber guide surface is between 90° and 210° . Furthermore, the direction of the torsion of the fiber guide surface is the same as that of the rotating air current provided by said nozzle. Furthermore, the fiber introduction member includes a generally cylindrical outer frame member and a fiber guide member in which the fiber guide surface having the torsion angle is formed. In addition, the detachable fiber introduction member is inserted into a hole portion formed on the front roller side of the nozzle.

DETAILED DESCRIPTION OF THE PREFERRED EMBODIMENTS

An embodiment of the present invention is described below mainly with reference to FIGS. 1 and 2, but other embodiments also fall within the scope of this invention unless they deviate from the aim of the present invention.

Figure 1:
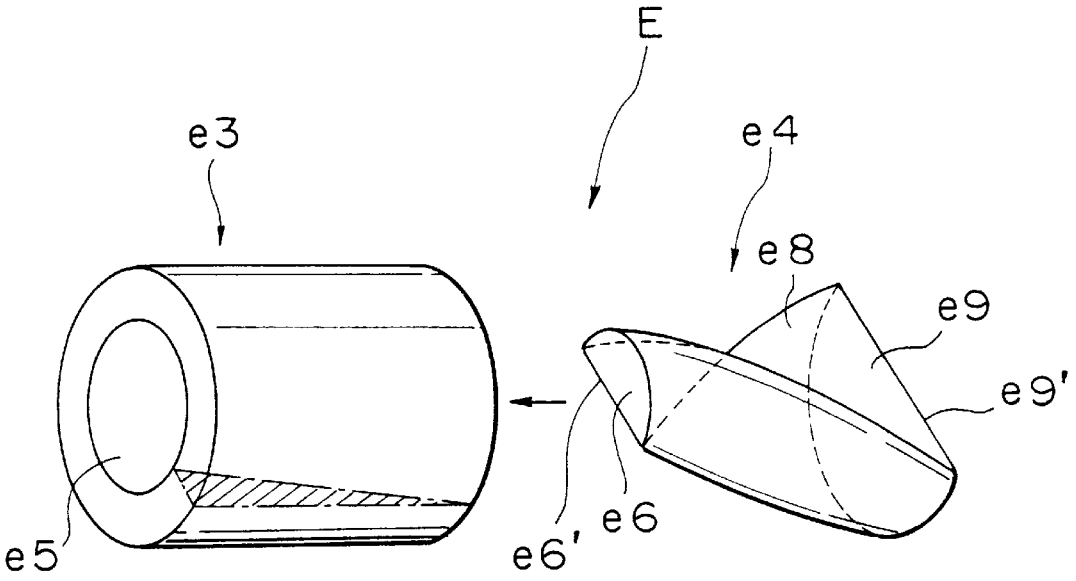
FIG. 1 is an enlarged exploded view of a fiber introduction member of a spinning apparatus according to the present invention.
Figure 2:
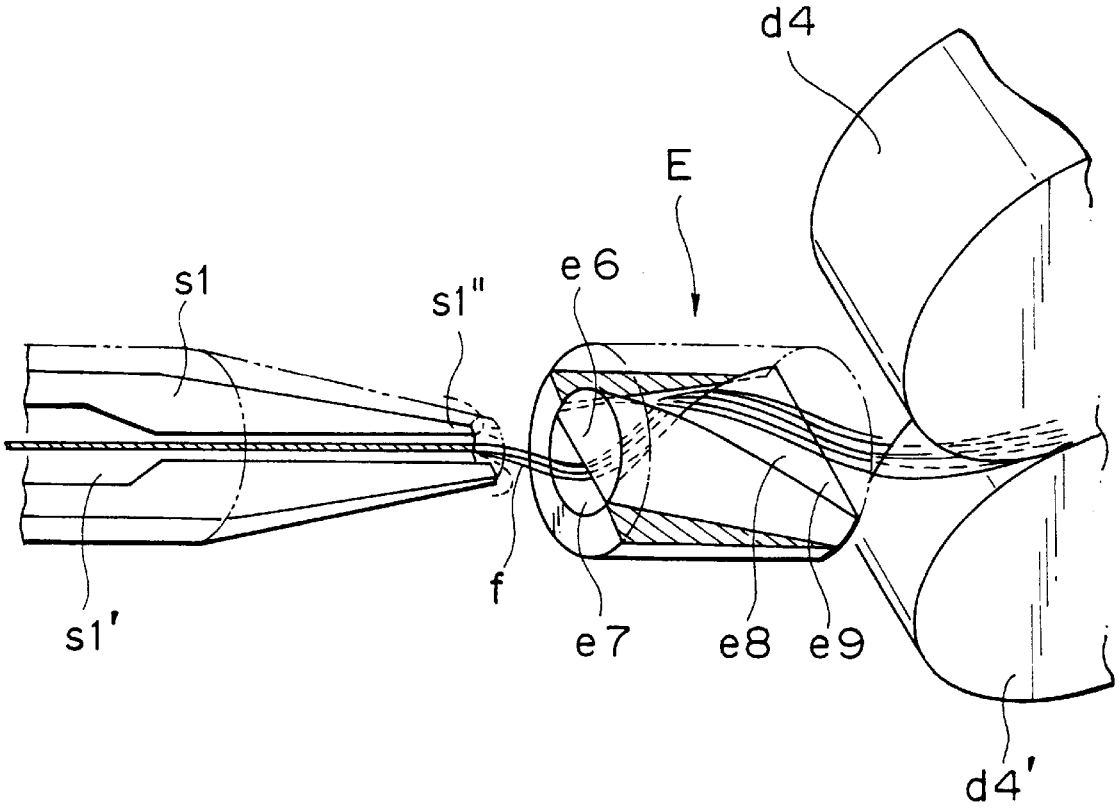
FIG. 2 is a perspective view of the fiber introduction member and a hollow spindle, including a partial cross section, that is used to describe a process for producing a spun yarn according to the spinning apparatus of the present invention.
Figure 3:
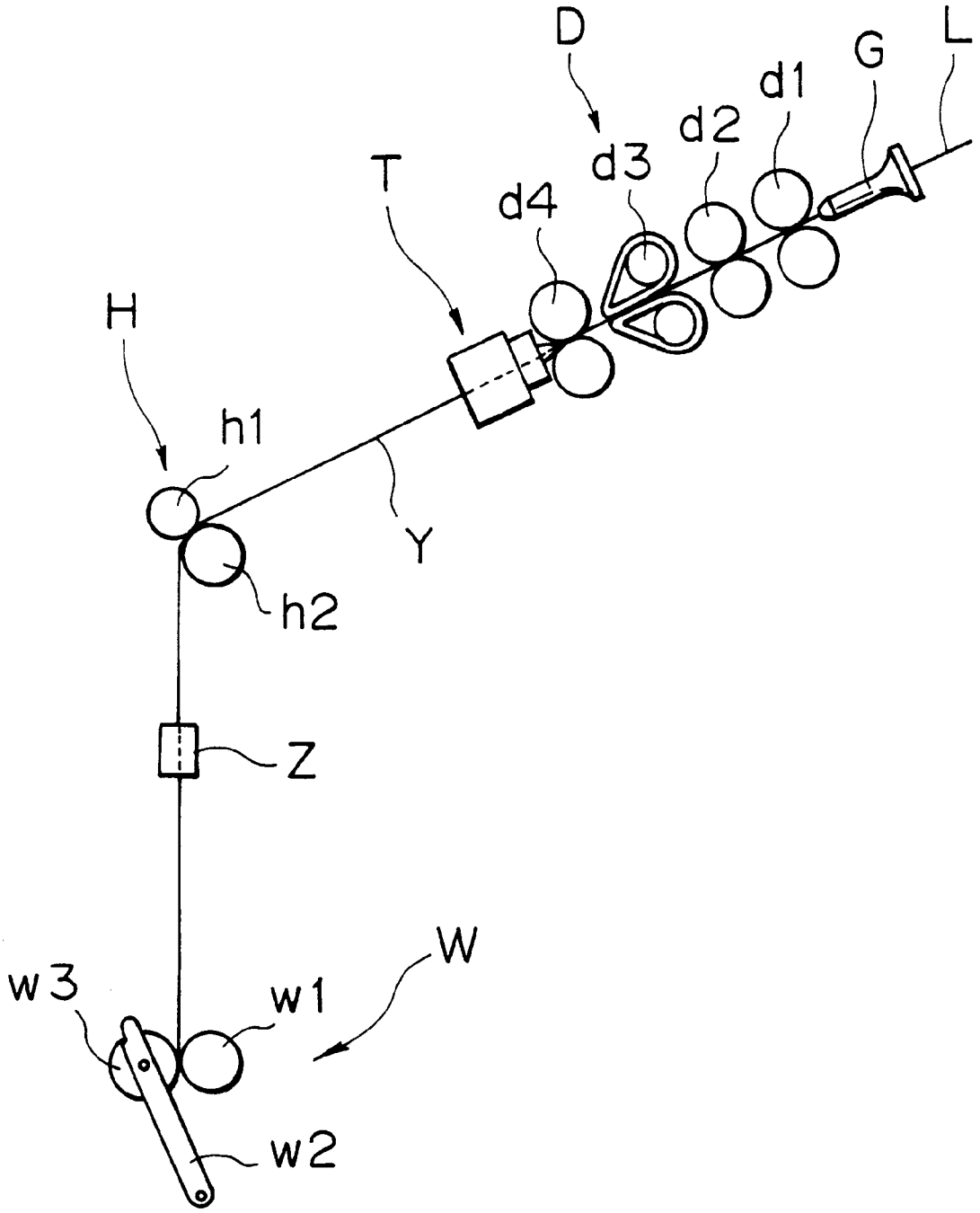
FIG. 3 is a schematic side view of a single spinning unit of the spinning apparatus.
Figure 4:
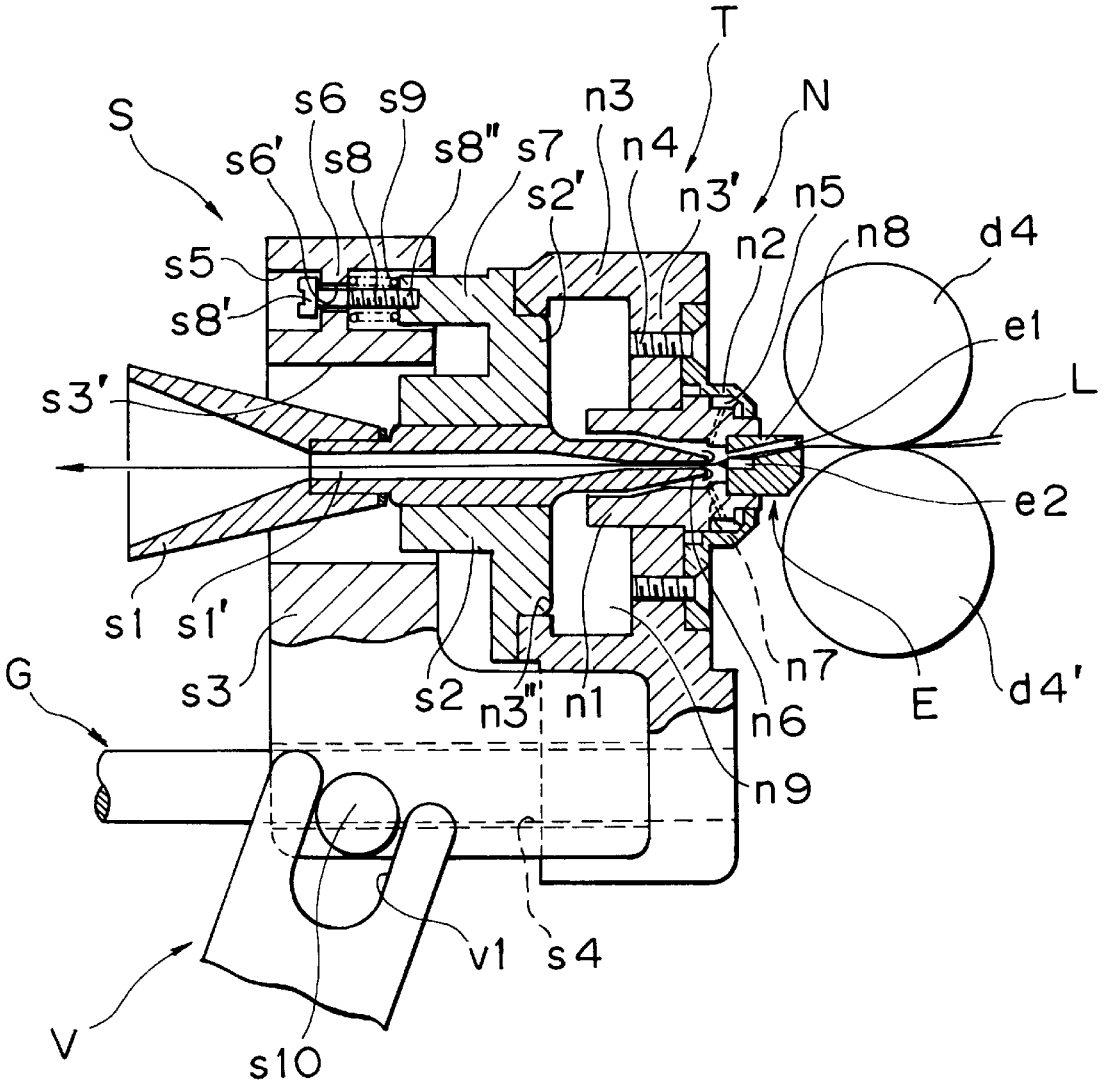
FIG. 4 PRIOR ART
FIG. 4 is a vertical cross sectional view of a conventional twist device consisting of a nozzle member and a spindle member.
Figure 5:
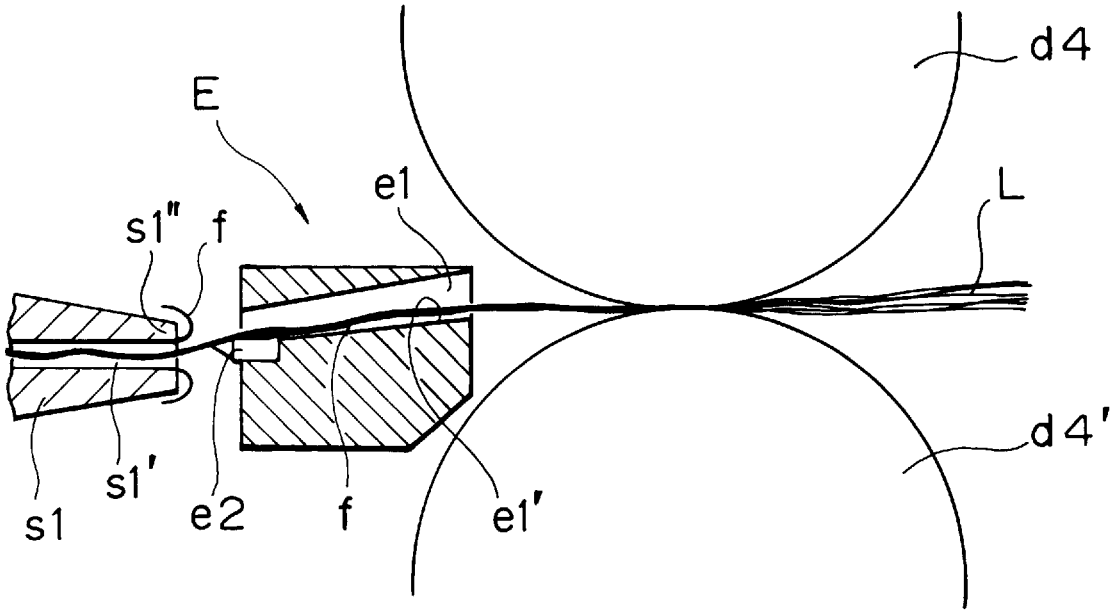
FIG. 5 PRIOR ART
FIG. 5 is a vertical cross sectional view of a conventional fiber introduction member and a hollow spindle.

A fiber introduction member E is composed of a generally cylindrical outer frame member e3 fitted in the recessed portion n8 formed on the front roller d4 side of the nozzle n1, and a fiber guide member e4 shaped like an a truncated cone that is cut in half along the center line and the smaller diameter side of which is twisted relative to the larger diameter side, as shown in FIG. 1. An inner hole e5 in the outer frame member e3 is formed as a hole shaped like a reverse truncated cone, as is apparent from the cross section of the circumferential wall of the outer frame member e3, including the center line that is shown by hatching in FIG. 1. As shown in FIG. 1, the fiber guide member e4 is inserted into the outer frame member e3 from its small diameter portion e6. Thus, a half of the inner hole e5 of the outer frame member e3 is occupied by the fiber guide member e4 with the remaining half forming a fiber introduction hole e7.

Next, the shape of a fiber guide surface e8 of the fiber guide member e4 that guides the fibers f along a rotating air current is described.

The fiber guide surface e8 of the twisted fiber guide member e4 shaped like a truncated cone that is cut in half along the center line, and is a surface that is twisted from the larger diameter side e9 of the fiber guide member e4 toward its smaller diameter side e6, and is also formed to extend along the flow of a rotating suction air current generated near the fiber introduction hole e7 of the fiber introduction member E by air jetted from air injection holes n7. The torsion angle of the fiber guide surface e8 (i.e. the angle of a cutting line e6' of the smaller diameter side e6 of the fiber guide member e4 relative to a cutting line e9' of the larger diameter side e9 as seen from the larger diameter side e9 toward the smaller diameter side e6 or, in other words, the angular deflection undergone by the fiber guide surface e8 in traversing the length of the fiber introduction member E from the cutting line e6' of the smaller diameter side thereof to the cutting line e9' of the larger diameter side thereof) should be 90° or more and preferably be between 90° and 210° , depending on the type and length of fibers constituting a sliver L, the count of twist for spun yarn Y, or the hardness of the fibers. The torsional direction of the fiber guide surface e8 may be opposite to that shown in FIG. 1 depending on the direction of the rotating suction air current.

The fibers f transferred along the fiber guide surface e8 of the fiber guide member e4 by the rotating suction air current can be bundled more easily without the needle shaped guide member 2 by setting the torsion angle of the fiber guide surface e8 to a predetermined value, ensuring strong and flawless spun yarn Y with an improved parallelization degree of the fibers f. If the torsion angle of the fiber guide surface e8 is below 90° , the fibers f are distributed on the fiber guide surface e8 over a wide area and are difficult to bundle, degrading the parallelization degree of the fibers f, which causes the reduced strength and degraded appearance of the spun yarn Y. In addition, since the angle at which the fibers f are spirally wound round the fiber guide surface e8 is small, the twist applied by the rotating air current propagates to a nip point formed by the front roller d4 and its bottom roller d4', thereby preventing the fibers f fed from the front rollers d4 from being opened easily. As a result, the proper spun yarn Y cannot be produced.

By increasing the torsion angle of the fiber guide surface e8, the fibers f can be bundled easily to produce the strong spun yarn Y with an improved parallelization degree of the fibers f while the propagation of twist toward the front roller d4 can be hindered. If, however, the torsion angle of the fiber guide surface e8 is increased excessively, the fibers f may not be transferred smoothly along the fiber guide surface e8 depending on their physical properties, including the length and hardness, which may prevent spun yarn Y from being produced effectively.

Thus, the torsion angle of the fiber guide surface e8 is set as appropriate based on an appropriate theory or experiments, the type of fiber f and the humidity. If spinning is executed at a high speed such as 300 m/min. and if the torsion angle of the fiber guide surface e8 is 360° or more, the fibers f may not be transferred smoothly due to resistance. Therefore, the appropriate torsional angle of the fiber guide surface e8 is between 90° to 210° .

Next, the operation of the fibers f introduced from the fiber introduction hole e7 of the fiber introduction member E is described with reference to FIG. 2, which is a perspective view of the fiber introduction member E assembled into the apparatus, including a partial cross section.

The rotating suction air current generated near the fiber introduction hole e7 of the fiber introduction member E by the rotating air current formed by compressed air jetted from the air injection holes n7 flows from the larger diameter side e9 of the fiber guide member e4 toward the smaller diameter side e6 along the fiber guide surface e8 twisted in the same direction as the rotating suction air current from the larger diameter side e9 toward the smaller diameter side e6. Consequently, the fibers f transferred on the rotating suction air current are distributed on the larger diameter side e9 of the fiber guide member e4, then gradually transferred along the twisted fiber guide surface e8 while being bundled, before being passed through the hollow chamber n6, in which they are twisted and sequentially formed into spun yarn Y, which then passes through the hollow passage s1' of the hollow spindle s1 toward the winding section W.

As described above, since the present invention provides no needle shaped guide member e2 opposed to the tip s1" of the fiber introduction side of the hollow spindle s1, leaves and other foreign matter contained in the sliver L do not accumulate between the needle shaped guide member e2 and the hollow spindle s1, thereby reducing the frequency of yarn breakage and improving the spinning capability.

In addition, since the present invention provides no needle shaped guide member e2 opposed to the tip s1" of the fiber introduction side of the hollow spindle s1, the ballooning of the fibers f around the tip s1" of the hollow spindle s1 is not significant and unlikely to disturb the fibers f, enabling strong and uniform spun yarn Y to be produced.

Furthermore, since the present invention provides no needle shaped guide member e2 opposed to the tip s1" of the fiber introduction side of the hollow spindle s1, the leading yarn can be easily passed through the hollow passage s1' of the hollow spindle s1 and the fiber introduction hole e7 of the fiber introduction member E during piecing operation.

Furthermore, since the present invention provides no needle shaped guide member e2 opposed to the tip s1" of the fiber introduction side of the hollow spindle s1, the size of the hollow passage s1' of the hollow spindle s1 can be substantially increased to reduce the tension applied to the fibers f, thereby enabling soft and ductile spun yarn to be produced.

The conventional fiber introduction member E with the needle shaped guide member e2 disposed therein is suitable for spinning short fibers f since, even if the fibers f constituting the sliver L are short (for example, the average length is 1 inch or less), the fibers f are guided to the needle shaped guide member e2, the tip of which is located in proximity to the hollow passage s1' of the hollow spindle s1, or is inserted in the hollow passage s1', in which the spun yarn can be produced.

If the fibers f constituting the sliver L are long (for example, the average length is 1 inch or more), the gap between the needle shaped guide member e2 and the hollow passage s1' of the hollow spindle s1 is small, increasing the tension of the fibers f passing though this gap and resulting in hard and less ductile spun yarn Y being produced.

On the other hand, since the present invention provides no needle shaped guide member e2, a smaller amount of tension is applied to the fibers f, enabling soft and ductile spun yarn to be produced.

Due to the above configuration, the present invention has the following effects.

Since the torsion angle of the fiber guide surface of the fiber introduction member is 90° or more, the fibers can be bundled easily without a needle shaped guide member. In addition, the present invention prevents leaves and other foreign matter contained in the sliver from accumulating between the needle shaped guide member and the hollow spindle, thereby reducing the frequency of yarn breakage and improving the spinning capability.

Since no needle shaped guide member is present, the ballooning of the fibers around the tip of the hollow spindle is not significant and unlikely to disturb the fibers, thereby enabling strong and uniform spun yarn to be produced.

Since no needle shaped guide member is present, the leading yarn can be easily passed through the hollow spindle and the fiber introduction member during piecing operation.

Since no needle shaped guide member is present, the size of the hollow passage in the hollow spindle can be substantially increased to reduce the tension applied to the fibers, thereby enabling soft and ductile spun yarn to be produced.

Since the fiber introduction member is comprised of the outer frame and fiber guide members, the fiber guide member with the fiber guide surface having a large torsion angle can be manufactured compared to the fiber introduction member integrally formed.

Since the detachable fiber introduction member is inserted into the recessed portion formed on the front roller side of the nozzle, the present invention can cope with changes in the sliver.

We claim:

1. A spinning apparatus comprising:

a hollow spindle having an inlet end, a nozzle enclosing said inlet end of said spindle, a fiber introduction member defining an inlet to said nozzle and containing an inlet for receiving fibers to be spun, an outlet for discharging fibers in an at least partially spun state immediately upstream of said inlet end of said spindle, and a guide path defined by a fiber guide surface for conducting fibers admitted to said fiber introduction member in a spiral between said inlet for receiving fibers and said outlet for discharging fibers, said fiber guide surface defining a constantly convergent guide path and undergoing an amount of angular deflection of greater than 100° in traversing the length of said fiber introduction member between said inlet thereof and said outlet thereof, and means for inducing movement of said fibers through said fiber introduction member.

2. A spinning apparatus according to claim 1 in which the angular deflection of said fiber guide surface is greater than 100° and no greater than about 210°.

3. A spinning apparatus according to claim 1 or claim 2 wherein said means for inducing movement of said fibers along said guide path includes means for directing air tangentially through said nozzle for generating rotating air currents in said spinning apparatus and wherein the direction of the angular deflection of said fiber guide surface is the same as the direction in which a tangentially directed air current flows along said guide path.

4. A spinning apparatus according to claim 1 or claim 2 wherein the fiber introduction member includes an approximately cylindrical outer frame member enclosing a body containing said fiber guide surface.

5. A spinning apparatus according to claim 4 in which the fiber introduction member is detachably installed on the front roller side of said nozzle on a side thereof remote from said spindle.

* * * * *